United States Patent [19]

Alexander et al.

[11] Patent Number: 4,944,985

[45] Date of Patent: Jul. 31, 1990

[54] METHOD FOR ELECTROLESS PLATING OF ULTRAFINE OR COLLOIDAL PARTICLES AND PRODUCTS PRODUCED THEREBY

[75] Inventors: Guy B. Alexander, Salt Lake City, Utah; Ravindra M. Nadkarni, Wrentham, Mass.

[73] Assignee: Leach & Garner, North Attleboro, Mass.

[21] Appl. No.: 180,367

[22] Filed: Apr. 11, 1988

[51] Int. Cl.[5] ..... B32B 15/02; B32B 15/04

[52] U.S. Cl. ..... 428/570; 428/403; 428/404

[58] Field of Search ..... 428/570, 403, 404; 252/512, 513, 514

[56] References Cited

U.S. PATENT DOCUMENTS

| | | | |
|---|---|---|---|
| 2,370,242 | 2/1945 | Hensel et al. | 428/570 |
| 3,859,128 | 1/1975 | Burks et al. | 252/514 |
| 4,309,457 | 1/1982 | Kawasumi et al. | 428/570 |
| 4,447,501 | 5/1984 | Shigeru et al. | 428/570 |

FOREIGN PATENT DOCUMENTS

| | | |
|---|---|---|
| 49-113199 | 10/1974 | Japan . |
| 54-124297 | 9/1979 | Japan . |
| 58-52803 | 3/1983 | Japan . |
| 58-37166 | 4/1983 | Japan . |
| 61-166110 | 7/1986 | Japan . |
| 63-18096 | 1/1988 | Japan . |

OTHER PUBLICATIONS

"Sherritt Metal Powders", Sherritt Gordon Mines Ltd. Issue No. 3, Jan. 1960.

*Primary Examiner*—Melvyn J. Andrews
*Assistant Examiner*—David W. Schumaker
*Attorney, Agent, or Firm*—George W. Dishong

[57] ABSTRACT

The present invention provides a process for the electroless plating of easily reducible metals onto ultrafine, usually inert, particles. Such plating is achieved through careful and accurate control of such parameters as the feed rates of the various solutions, the control of pH of the solution, the temperature, pressure and the rate of agitation of the solution in which the plating is taking place. The plated ultrafine composite particles and the powders made from the particles produced by the process are also a part of the invention. There is also provided a metal article of manufacture consisting of a metla such as copper, silver, gold, ruthenium, rhodium, palladium, osmium and platinum with a plurality of shperical shaped ultrafine particles with a diameter of less than about 10 microns dispersed substantially evenly through the metal article. The articles are fabricated using the plated ultrafine composite powders by methods involving, such as for example, casting, powder metallurgy and mechanical compression. The ultrafine particle is most generally of an inert material. There is also provided a process for making cast articles and recastable mixtures using the plated composite ultrafine powder. The cast articles have the inert ultrafine particles dispersed evenly throughout the cast article.

14 Claims, No Drawings

METHOD FOR ELECTROLESS PLATING OF ULTRAFINE OR COLLOIDAL PARTICLES AND PRODUCTS PRODUCED THEREBY

BACKGROUND OF THE INVENTION

1. Field of the Invention

The present invention relates most generally to a process for the electroless plating of easily reducible metals onto ultrafine particles, a process for making alloy mixtures using the ultrafine particles having plating thereon and to the unique products produced thereby such as, metal powders of ultrafine colloidal sized particles with cores or centers with a dense and continuous plating of at least one metal and metal articles of manufacture having a plurality of ultrafine particles dispersed substantially evenly through the metal article. Such electroless plating is achieved through careful and accurate control of such parameters as the feed rates of the various solutions, the control of pH of the solution, the temperature, pressure and the rate of agitation of the solution in which the plating is taking place.

2. Description of the Prior Art

Applicant has searched both chemical and metallurgical abstracts, for specific systems such as gold-silica and silver-tin oxide, and has also searched under gold in addition to reviewing material by specific authors. No references to the application of electroless plating of noble metals on colloids or colloidal sized particles was found. No references to 14 K gold alloys which has been "extended" using an oxide metal or carbon filler was found. Also there was no process found for the electroless plating of ultrafine particles in an aqueous slurry and at temperatures below 90° C. and providing for the simultaneous and separate adding of both the complexed metal ion and an appropriate reducing agent. No prior art has been developed which discloses the process or the products disclosed herein by Applicant.

Some Patents which are representative of the general field of art in which the invention may be classified are discussed.

The German Patent 1,143,372 to Mackiw et,al discloses that the powdered material to be metallized by treatment with a metal salt solution in reducing medium is treated in an ammoniacal metal salt solution of Os, Rh, Ru, Ir, Au, Pt, Pd, Ag, Cu, As, Pb, Sn, Ni or Co with reducing gases at a partial pressure of less greater than 4 atm. and a temperature of greater than 90° C.

Christini et al (U.S. Pat. No. 3,940,512) concerns electroless plating in a "tumble barrel". The particles being plated or coated are extremely large relative to the particles being plated according to the present invention. The particles referred to in Christini et al as being sized from 0.05 to 100 microns are particles which are in the plating solution but are not the "articles" being plated upon. There is no discussion of nor is there a showing of concern for aggregation of plated articles. There is no need for such concern because of the very large relative size of the articles being plated as compared to the particles being plated in the present invention.

U.S. Pat. No. 4,403,001 concerns silver electroless plating on diamond. Suffice it to say that there is a great difference in the behavior of amorphous, spherical oxide particles in colloidal solution and a suspension of diamonds. In aqueous solution, colloidal particles of oxides can and will coalesce whereas, in aqueous suspensions, crystalline diamond will not. For this and other reasons it is easy to coat or plate diamonds with silver without gross aggregation and the formation of so-called "popcorn balls". Such is not the case for colloidal aquasols of silica or tin oxide which are some of the particles plated by the processes of the present invention.

U.S. Pat. No. 3,218,192 concerns coating phosphorus with nickel or cobalt. The particles are 1 to 400 microns are dispersed in a suspension. It is important to note that suspensions and colloidal solutions are very different and require very different treatment. A thorough and detailed discussion of colloidal chemistry can be found in R. K. Iler, "The Chemistry of Silica, Solubility, Polymerization Colloid and Surface Properties, and Biochemistry", Wiley Interscience 1979. In the prior art there is no teaching of or appreciation for the critical nature of stability of particles. The treatment of diamond and other crystalline particles and graphite and red phosphorus is not the same as the treatment of, for example colloidal silica or complex oxides.

U.S. Pat. Nos. 4,353,741, 4,240,830, 4,403,506 all disclose methods which involve the electroless plating of small particles in a solution. For example, U.S. Pat. No. 4,353,741 discloses a process in which a slurry of particles is coated with silver. In the process, a reducing agent such as hydrazine is added to a slurry of particles in a solution containing a silver salt. It should be noted that the solutions are not added simultaneously.

U.S. Pat. No. 3,556,839 discloses a process in which diamond particles are coated with nickel or cobalt in an electroless process. In the process, a metal salt solution and a reducing agent are utilized.

U.S. Pat. No. 3,062,680 discloses a process for the electroless coating of fine particles. The particles are dispersed in a metal solution and the metal salt is reduced by means of a gaseous reducing agent.

U.S. Pat. No. 2,853,398 discloses a method of making metal plated particles. In the process, particles of one metal are dispersed in a solution containing a dissolved metal salt and the metal is precipitated onto the particles by reduction with a gas. An additional reducing agent, such as hydrazine, is used to treat the particles to assure depostion of the metal onto the particles. It is said that the particles may vary in size from 1–200 microns or smaller. The reaction temperatures in the process are high, plating concentrations are high and the use of 0.33 molar nickel solution (38.4 gram of nickel in 2,000 milliliter—see Example 1) will cause the negatively charged silica sol particles or the negatively charged tin oxide particles to aggregate prior to the coating process. The process taught would destroy a colloid before it could be electrolessly plated with metal. Of similar interest are U.S. Pat. Nos. 2,853,401 and 2,853,403.

U.S. Pat. No. 2,424,085 discloses a process of making catalyst particles by applying a silver coating onto the particles. The silver is applied by reducing a silver salt in a solution containing a reducing agent such as hydrazine.

The prior art does not disclose methods or processes for the uniform dispersion of ultrafine colloidal particles (less than about 20 microns) such as silica throughout a metal or an alloy. It would be of considerable value to be able to disperse such ultrafine particles throughout a noble metal such as gold thereby "extending" the gold. That is to say, being able to obtain more use from or make more articles from a given amount of gold. It is important that the extended gold or other metal have substantially the same appearance and working characteristics as the unextended gold or other metal. It would also be desirable to be able to make a metalliferous powder of ultrafine particles which powder particles would have, for example, a core or center of silica or a base metal having plated thereon, a dense and continuous coating of a metal. This metallic powder would then be useful in the making of metal articles which have the core material evenly dispersed throughout the article, by cold or hot pressing or by casting with alloys or recastable alloy mixtures made with the powder particles. Again, the prior art does not disclose such products or processes for making such products. Prior art attempts to plate small particles have been limited to particles considerably larger than those which can be plated by the processes of the present invention. It has been attempted in the past to extend gold by the incorporation of refractory materials, by powder metallurgy blending techniques, but such materials cannot be cast.

Electrical contactors and/or connectors are presently made in the United States using silver with cadmium oxide added to suppress the arc which form during use. Cadmium is toxic, and its use in contacts has been banned in some countries. The Japanese are using tin oxide, and are investigating other substitutes, including the oxides of tin, indium, nickel, manganese, aluminum and iron. There is also an active research program in Germany to find a substitute for cadmium.

The silver-tin oxide materials are prepared either by internal oxidation or by powder metallurgy techniques. In the former process and depending on the concentrations used, an oxide case may form around the silver-tin alloy. This prevents further oxidation of the tin, and limits the concentration of oxide that can be included in the composite. Contacts prepared by powder metallurgy are less brittle than the internally oxidized counterparts but the tin oxides in powder metallurgy materials grow as needles, which degrades the properties (ductility) of the contact material.

There is need in the United States to eliminate cadmium oxide from electrical contacts. The process and products herein disclosed suggests an entirely new and novel approach to filling this need. By the process of this invention, silver-tin oxide contacts can be made by electroless plating onto ultrafine tin oxide particles a coating of silver resulting in a powder which can then be formed into silver-tin oxide electrical contacts. Such powders are much more uniform in microstructure. Such uniformity means that the metals produced therefrom are more ductile and the properties of the composites are more uniform within the metal structure. Higher concentration of tin oxide in silver can be prepared. There appears to be no upper limit for the relative amount of tin oxide. Volume loadings as high as 50 percent have been made. There is no evidence that needle like tin oxide particles are formed on the thermal aging of the powders. Under proper conditions the powders can be processed by casting. Casting has many advantages in the forming of articles for electrical use.

SUMMARY OF THE INVENTION

In its most basic form, the present invention provides a process for the electroless plating of easily reducible metals onto ultrafine particles; the plated ultrafine composite particles and the powders made from the particles produced thereby and the articles fabricated using such plated ultrafine composite powders by methods involving, such as for example, casting, powder metallurgy and mechanical compression.

An object of the present invention is to provide a metal article of manufacture comprising; a metal, reducible from an aqueous solution with chemical or electrochemical means, selected from the group consisting of copper, silver, gold, lead, tin, nickel, zinc, cobalt, antimony, bismuth, iron, cadmium, chromium, germanium, gallium, selenium, tellurium, mercury, tungsten, arsenic, manganese, iridium, indium, ruthenium, rhenium, rhodium, molybdenum, palladium, osmium and platinum which metal is plated onto substantially each particle of a plurality of ultrafine particles having an average particle size of less than about 20 microns dispersed substantially evenly through the metal article. The ultrafine particle is frequently of an inert material but primarily a material that will not react rapidly with the aqueous solution.

Another object of the present invention is to provide a process for the electroless plating of a substantially uniform, stable and dense deposition of at least one metal selected from the group consisting of copper, silver, gold, lead, tin, nickel, zinc, cobalt, antimony, bismuth, iron, cadmium, chromium, germanium, gallium, selenium, tellurium, mercury, tungsten, arsenic, manganese, iridium, indium, ruthenium, rhenium, rhodium, molybdenum, palladium, osmium and platinum onto ultrafine particles of a predetermined size and in the form of colloidal particles in a colloidal solution the process comprising: (a) forming an aquasol of the ultrafine particles having a specific relative amount of the particles; (b) agitating the aquasol in an appropriate vessel; (c) feeding into the vessel and into the aquasol, at a controlled predetermined feed rate and under conditions for good mixing, a first feed mixture of a dilute solution of a soluble salt of the metal, the metal ion being complexed so that the concentration of the ion available for reaction is reduced and a second feed mixture of an appropriate reducing agent; (d) controlling to predetermined values, which values depend upon the metal, both the pH and the temperature of the aquasol (having both the first and said second mixtures added thereto) between about 2 and 12 and between about 10° C. and 90° C. respectively; and (e) stopping the process when the ultrafine particle has a coating of a predetermined thickness.

A further object of the present invention is to provide a process for making a plated composite ultrafine powder wherein the plated composite ultrafine powder particles have a core portion of a size less than about 20 microns and a coating portion comprising a plurality of layers, a first layer adjacent to the core portion being a complex oxide such as a perovskite or a silicate selected from the group of tin silicate, copper silicate, cobalt silicate or nickel silicate or a spinel, such as nickel or copper aluminates or other general structures which are defined as a complex oxide and each of the other layers being a substantially uniform, stable and dense deposition of at least one metal selected from the group consisting of copper, silver, gold, lead, tin, nickel, zinc, cobalt, antimony, bismuth, iron, cadmium, chromium, germanium, gallium, selenium, tellurium, mercury, tungsten, arsenic, manganese, iridium, indium, ruthenium, rhenium, rhodium, molybdenum, palladium, osmium and platinum comprising the steps of: (a) forming an aqueous suspension substantially free of electrolytes having a specific weight percent of the ultrafine particles to be plated which have a core portion and a coating portion of the first layer; (b) agitating the suspension in an appropriate vessel; (c) feeding into the vessel and into the suspension, at a controlled predetermined feed rate of between about 0.2 to about 3.0 millimoles of metal per minute per square meter of surface area of the ultrafine particles to be plated, a dilute solution of a soluble salt of a metal to be plated of the plurality of metals, the ion of the metal to be plated being a complex; (d) introducing an appropriate reducing agent separate from the metal to be plated into the suspension; (e) controlling both the pH and the temperature of the suspension (having the dilute solution and the reducing agent added thereto) to predetermined values between about 2 and 12 and between about 10° C. and 90° C. respectively, which values depend upon the metal to be plated; (f) stopping the process when the coating portion is of a predetermined thickness; and (g) recovering from the suspension the plated composite ultrafine powder having a plurality of layers of the metal thereon.

A still further object of the present invention is to provide a process as described in the preceeding paragraph but without the complex oxide and/or the metal silicate coating as a first layer and where the other layers is at least one of the plurality of metals.

Yet another object of the present invention is to provide an ultrafine composite powder consisting of a plurality of ultrafine particles, the particles comprising: a core portion of material having an average size less than about 20 microns; and a coating portion comprising a plurality of layers, a first layer adjacent to and contiguous with the surface of the core portion and being a complex oxide and each of the other layers being a substantially uniform, stable and dense deposition of at least one metal selected from the group consisting of copper, silver, gold, lead, tin, nickel, zinc, cobalt, antimony, bismuth, iron, cadmium, chromium, germanium, gallium, selenium, tellurium, mercury, tungsten, arsenic, manganese, iridium, indium, ruthenium, rhenium, rhodium, molybdenum, palladium, osmium and platinum.

A yet still another object of the present invention is to provide a powder as described in the preceeding paragraph but without the complex oxide coating as a first layer on the particles of the powder and wherein the size of the particles is less than about 1 micron.

A yet further object of the present invention is to provide a process for making cast articles and recastable mixtures using the plated composite ultrafine powder consisting of a plurality of plated composite ultrafine particles, the particles comprising; a core portion of material having an average size less than about 20 microns; and a coating portion comprising a plurality of layers, with a first layer adjacent to and contiguous with the surface. The material of the first layer being a complex oxide. Each of the other layers being a substantially uniform stable and dense deposition of at least one metal selected from the group consisting of copper, silver, gold, lead, tin, nickel, zinc, cobalt, antimony, bismuth, iron, cadmium, chromium, germanium, gallium, selenium, tellurium, mercury, tungsten, arsenic, manganese, iridium, indium, ruthenium, rhenium, rhodium, molybdenum, palladium, osmium and platinum. The cast articles have the core portion dispersed substantially evenly throughout the cast article. One of the processes comprises the steps of: (a) pressing a predetermined amount of the plated composite ultrafine powder into a slug; (b) melting zinc in an appropriate reactor vessel; (c) dissolving the slug into molten zinc producing an alloy; (d) distilling out the zinc from the alloy by evacuating and heating the reactor vessel leaving a resulting mixture comprising at least one metal and having the core portions dispersed evenly therethrough; and (e) cooling the resulting recastable mixture. Another of the processes comprises the steps of: (a) preparing a master alloy of tin or zinc; (b) melting the master alloy; (c) dissolving a predetermined amount of the ultrafine powder into the master alloy producing an alloy mixture comprising the master alloy and at least one metal, the alloy mixture having the core portions dispersed evenly therethrough; and (d) cooling the resulting recastable alloy mixture.

Other objects of the invention may and will be apparant to those of ordinary skill in the art upon reading the following detailed description of the invention.

DESCRIPTION OF THE PREFERRED EMBODIMENTS

In describing the invention, the small particles will generally be referred to as ultrafine particles, or in some instances they may be called dispersoids. The average size of the dispersoid or ultrafine particle being less than about 20 microns. The particle is most preferably silica but may be material such as for example carbon, alumina, tin oxide, zirconia, metal powders such as molybdenum, tungsten, copper, nickel, iron, cobalt and alloys of these metals or these with other metals water insoluble metal silicates (e.g., zinc silicate, lead silicate, aluminum silicate, calcium aluminum silicate, magnesium aluminum silicate, zirconium silicate, sodium aluminum silicate, potassium aluminum silicate and rare earth metal silicates), metal oxides, complex oxides or other material which may or may not be inert and which can be processed into ultrafine particles. When the particles are substantially spherical in shape or colloidal, the diameter of the particles are preferably less than 0.5 microns and in some instances the preferred range of size is 5 to 500 nanometers.

In some instances the ultrafine particles will be considered as an extender, that is material used to extend the use of an amount of material such as gold by changing the density. In other cases, the particles may be useful as a dispersion hardening agent. I.e., the particles with a coating of a complex oxide such as for example tin silicate more evenly distribute themselves throughout the article or the alloy when such coated particles are used to make alloy mixtures, or used to make alloy powder or serve some additional function such as electrical arc suppression. As an example, silica with a nickel silicate coating which is included in a composite of gold-silica or silver-silica is wetted by and is dispersed in molten metals containing zinc. Without the coating or without the zinc, silica slags out. With the coating and with the zinc in the molten alloy to which the composite is added, the silica distributes itself evenly in the molten metal and also is evenly distributed in the casting. After the ultrafine particles or core portions have been plated by the electroless plating process taught and claimed herein, the resulting particles are referred to as plated ultrafine particles which when filtered and dried are then in the form of a powder, the powder being a plurality of the particles. This powder, depending upon the material of the core portion of the plated particles, can be hot pressed or cold pressed or melted and cast into a finished product or the powder could be used in one form or another to make alloys, and to make alloys which have the core material, frequently but not necessarily inert material such as silica, evenly dispersed throughout the alloy. The alloy mixture, that is the alloy of metals having such material as silica dispersed throughout, because of the processes of this invention are castable and recastable into specific articles such as jewelry and the like. Obviously, a fixed amount of, for example gold, can be used to create more articles of manufacture when the gold is extended by the ultrafine particles.

For purposes of the invention, the ultrafine particles to be coated by the electroless plating processes of the invention may be in the form of colloidal solutions or suspensions or dispersions or slurries. When and if the word, "slurries", is used in the processes of the invention, it will be understood that this includes (a) suspensions of inert materials, (b) dispersions of inert materials or (c) colloidal solutions of inert materials, any of which are in condition to be treated by the processes of the instant invention.

Complex oxides are useful as coatings on ultrafine particles providing what may be called a coating portion on a core portion. As used herein, complex oxides may be characterized as those oxides in which there are at least two atoms other than oxygen in the oxide. If there is an atom A and it is present x times in the oxide formula and there is an atom B and it is present y times and the oxygen atom O is present z times then a general formula for a complex oxide would be: $A_xB_yO_z$. Calcium metasilicate is a complex oxide in which there is 1 calcium atom to 1 silicon and 3 oxygen atoms. Coatings of complex oxides on nuclei, the nuclei being simple oxides, or other inert materials, perform useful functions in the processes herein disclosed. Complex oxides can be perovskite, or spinels or of other general structures. Perovskite types may include for example nickel silicate, cobalt silicate or copper silicate and it is preferred that the ratio of the metal to silicon be in the range slightly less than 1:1. Nickel and copper aluminates are examples of spinels which are useful in disclosed processes. Further, if a complex oxide is used to assist in the casting process then the complex oxide should comprise an oxide which is easy to reduce and one which is not. Silica is not and copper oxide, nickel oxide, tin oxide and cobalt oxides are. So these metal silicates are complex oxides, the nickel, cobalt, tin or copper portion of which can easily be reduced by metals like zinc. These metal silicates are ideal complex oxides in composites which are to be used in the casting processes. Similarly, nickel aluminate is a complex oxide which could be substituted for the silicates. Broadly, complex oxides may be silicates, aluminates, zirconates, chromates or titanates.

It is also possible by the processes of the invention, to electrolessly plate ultrafine particles which have been coated with a complex oxide as a silicate such as, for example, tin silicate or copper silicate. The coated particles, being a core portion having a coating thereon are referred to, in most instances, as composite ultrafine particles. The composite particles when plated are then called plated composite ultrafine particles. The coated particles or composite particles are preferred for use in the processes for making castable and recastable alloy mixtures and for use in the articles of manufacture made using such alloy mixtures. It should be noted that the complex oxide for the purposes of this invention must contain at least one easily reducible oxide and one that is difficult to reduce. Examples of easily reducible oxides are copper oxide, nickel oxide, cobalt oxide and tin oxide. Oxides which are more difficult to reduce are, for example, silica, alumina, calcia and magnesia.

In order to better understand the details of the instant invention and in order to fully explain the invention, the detailed description is divided into various sections or parts. The first section describes the electroless plating processes. The second section describes some of the various powders that are produced by the processes. The third section describes the casting processes and the products which are castable and recastable because of the products and the processes disclosed. In the fourth section there is a description of some of the uses of the products. Finally, the fifth section describes some of the examples of processes and products.

It is very important to note that the ultrafine particles are very small and are frequently part of colloidal solution. A colloid is a material that is so finely divided that it will not settle. Colloidal particles can be solids in liquids. Colloidal particles are really in the form of polymers. One definition of a colloid is that it will not settle. Thus colloidal silica in water will not settle out. The Brownian motion of the molecules in the water which bombard the silica is sufficient to keep the colloid suspended. As a colloidal particle grows in size, it will eventually get so large that it will settle and at this stage it is no longer truly colloidal. Because different oxides have different densities, the particles of one material of a given size may be heavier than those of a less dense material. Silica has a density of 2 grams per cubic centimeter (g/cc) and will not settle in water while gold has a density of 19. Silica particles of 100 nanometers will not settle, while those of gold will. Thus the colloidal size range is different for every solid which has a different density. Thus, it is clear that colloidal size is not a precise size and the composition must be stated before one knows what size one is talking about when one says colloidal. On the other hand, if one says colloidal solution one knows that the colloidal particles will remain dispersed and will not settle regardless of this density.

Colloidal particles are typically only a few hundred atoms across. Colloidal particles have a very large surface area when compared to macroscopic particles. Because of this very large surface, there is a strong tendency for reactions at the surfaces of the particles. Aggregation and gelation is a typical reaction that occurs with colloidal particles—and which would not occur with macroscopic particles. Colloidal particles will readily sinter, whereas macroscopic particles will not.

Because of the large surface to weight ratio of colloids, colloidal particles are tender—that is they must be treated with care or they will not remain colloidal. Electroplaters do not understand the care necessary and thus do not and have not developed processes which will preserve the colloidal nature of the particles that are being coated and/or plated. The chemistry of colloids is rather special and the mechanical and the chemical behavior of colloids and/or colloidal solutions is not completely understood even by those of extraordinary skill. Very special considerations must be given to the handling of colloids in order to keep them from, for example, agglomerating. Disclosed herein are the conditions and procedures that are necessary in order to produce the products of the invention. No one has previously been able to develop a process or processes which produce the products disclosed herein.

ELECTROLESS PLATING PROCESSES

In describing the invention, the core component is referred to frequently as the dispersoid. The dispersoid may be an extender which is used to extend a precious metal or it may be useful, for example, as a dispersion hardening agent. The ultrafine particle size, or the dispersoid size, should be below about 20 microns. When the dispersoid is used as an extender for precious metals, it is preferred that it be smaller than 0.5 microns. There are many uses in which the preferred size is in the range of 5 to 500 nanometers. For many uses, the particle shape should be spherical or nearly so. Elongated particles or plate like particles can be used if one wishes to impart stiffness to the metal.

The ultrafine particles may be either crystalline or amorphous, metals or ceramics. Particles may approach cubes in shape. When used as extenders for precious metals, the particles should be substantially spherical and should have an average size in the range below 2 microns and preferably in the range of 100 to 500 nanometers in diameter. It should be pointed out that crystalline materials usually are not nearly as tender as colloids which are amorphous. Crystalline materials can be treated by the processes of the invention. One must be careful not to equate crystalline and amorphous. Much of the prior art deals with nickel coating on diamonds. These crystals can be treated without aggregation but colloids which are amorphous cannot be treated by the processes of the prior art.

Aquasols such as "Ludox" from E. I. duPont de Nemours and Company are useful starting materials. That is, the colloidal particles of silica are sufficiently small and properly configured so that they can be used in the processes to produce the powders and the other products of the invention. There are many other aquasols which are available, including alumina, zirconia and titania. Aquasols of silica with larger particles can be prepared by autoclaving "Ludox" at elevated temperatures, as taught by Iler, "The Chemistry of Silica", J. Wiley and Sons, 1979. Since the density of silica is low, about 2.2 grams per cubic centimeter, silica is an ideal extender for alloys like 14 K gold.

The surface character of the particles can be adjusted for the processes of the invention. For example, it has been shown that, during the plating process, colloidal silica tends to aggregate or agglomerate when silver is electrolessly deposited but a complex oxide such as tin oxide or a metal silicate such as tin silicate coated ultrafine particles do not. Therefore if one wishes to make a colloidal aquasol of silver, for use in silver inks, then it is desirable that the surface of the colloidal particles be coated with a monolayer of a complex oxide or a metal silicate such as for example tin oxide or tin silicate. Alternately, the particles can themselves be tin oxide of tin silicate rather than silica coated with tin oxide of tin silicate.

The metals which can be electrolessly deposited onto the ultrafine particles or core materials or onto composite ultrafine particles i.e., those particles having a core with a coating of a metal oxide or metal silicate are those metals which are reducible from an aqueous solution with chemical or electrochemical means, selected from the group consisting of copper, silver, gold, lead, tin, nickel, zinc, cobalt, antimony, bismuth, iron, cadmium, chromium, germanium, gallium, selenium, tellurium, mercury, tungsten, arsenic, manganese, iridium, indium, ruthenium, rhenium, rhodium, molybdenum, palladium, osmium and platinum. These metals could be characterized as having a standard electrode potential E° for reduction of ion in solution to metal of between about a $-1.1$ volts and about a $+3.0$ volts.

It should be clearly noted that all of the above listed metal oxides do not perform equally as well in the various processes. For example, chromium and molybdenum are much more difficult to work with in the various processes and would not be considered preferred materials.

Aqueous solutions of the salts of these metals are used in the process of the invention. Salts which are used should be readily soluble. Gold chloride, silver nitrate, copper chloride or nitrate or acetate are examples of salts which can be used in the processes of electrolessly plating onto ultrafine or colloidal particles.

In the preferred embodiment of this process the metal ions fed to plating baths in the processes of the invention should be complexed so that the concentration of the ion available for reaction is reduced. A smoother coating is obtained when this is the case. Silver ion can be complexed with ammonia, for example, and copper ion with tartrate. Reducing agents which can be useful in the invention include hydroxylamine, oxalic acid hydrazine, sodium borohydride and formaldehyde. Hydroxylamine is useful in reducing gold complexes and formaldehyde is useful in reducing complexes containing copper or silver. A solution of a soluble metal salt, in the form of a complex, together with a solution of the reducing agent are fed into a colloidal solution, suspension or dispersion or slurry containing the dispersoid. A colloidal aquasol is a preferred starting material for dispersoids used in the invention. The feed solutions are added under conditions of good mixing. Vigorous agitation is used to mix the dispersoid and the reactants. A creased flask can be used in the laboratory and a baffled tank may be used in larger operation. It is important that the plating conditions are such that uniform dense coatings of the metal are deposited on the dispersoid. This requires good mixing, the use of metal ions which are complexed, proper feed rates, and proper and controlled pH and temperature.

During the plating process the amount of electrolyte in the bath should be limited. Monovalent electrolytes should be less than 0.2 normal and it is preferred that they are less than 0.1 normal. Polyvalent salts should be even less concentrated, that is they should be less than 0.03 normal. Generally, the polyvalent ions should be low. Success has been achieved using nickel, cobalt, and copper. The charge on the colloid makes a difference as to what polyvalent ions can be tolerated. For example, silica in alkaline aqueous solutions is negatively charged. Stannate ions being polyvalent and negatively charged have little effect on the colloidal stability of silica sols. But other polyvalent ions—such as calcium and nickel do. In the case of nickel, so long as silicate and nickel salts are added at substantially the same time one can add 0.8 to 0.9 nickel atoms to each silicate or silicon atom. In the case of calcium the sol is not as tolerant. The depositions conditions should be controlled so that the metal is deposited uniformly. Feed solutions should be introduced separately so that there is no premature reaction. Metal should deposit onto the ultrafine particles or dispersoid and not on the reactor or on the metal itself. To accomplish this, the temperature, pH and feed rate must all be controlled. In any case, the temperature should be below 90° C. and for gold plating should be in the range of about 18° C. to about 25° C. For silver, the temperature should be around 50° C. and for copper around 90° C. An acid solution is preferred for gold plating and an alkaline solution for silver or copper.

In general, the rate of addition of the metal salt is adjusted so that it is in the range of 0.2 to 3.0 millimoles of metal per minute per square meter of surface of dispersoid in the solution which is being treated. The surface of the dispersoid can be calculated from the specific surface of the dispersoid in square meters per gram times the weight in grams of dispersoid in the solution being treated. When silica is being plated with gold at 25° C. and pH of 4, the preferred rate of addition is 0.6 millimoles of chlorauric acid per minute per square meter of total surface of the silica being coated. When a silicate or a silica coated with a silicate is being plated with copper at 90° C. and a pH of 12, the preferred rate is about 2 millimoles per minute per square meter of surface. Note that at a pH of 12 colloidal silica will dissolve. The colloidal silica is therefore treated with nickel, copper or with any one or combination of many other metals, it becomes, for example, nickel silicate. If the ratio of nickel to silicon in such oxides is less than about 0.8:1, then the nickel silicate will behave much like colloidal silica, with some exceptions, one of which is that is no longer soluble in water at pH 12. The point being that the pH selected for plating must be such as not to destroy the colloid by dissolving it or the colloid must be altered so that it is stable under the conditions necessary for plating. Very alkaline plating baths can not be used with colloidal silica, but could be used with colloidal metal silicates which are insoluble in such alkaline solutions. For plating silver, at a pH of 8 and a temperature of 50° C. the feed rate of silver diamine salt should preferably be about 0.4 millimoles of complex per minute per square meter of surface of dispersoid in the plating bath. The rate of addition of the feed solutions should be as fast as can be tolerated so that all dispersed particles will be coated. The rate must be controlled so that the metal does not nucleate and deposit on itself.

The conditions under which the metal is deposited have effects on the properties of the resulting composite. In the case of dilute solutions, the products tend to be less aggregated than if concentrated solutions are used. The temperature and pH affect the plating rate and if conditions are changed from those given above, new feed rates should be determined. If the feed rate is too slow, some of the dispersoid particles may not be coated. If the feed rate is too rapid, there is a tendency in some systems for the colloid to aggregate.

In electrolessly plating gold, using chlorauric and hydroxylamine as the feed solutions, a pH of 4 is preferred over a pH of either 2 or 7. The particles are less aggregated and the coating is more reliable from pH 4 baths. Composites prepared at pH 4 have greater thermal integrity. For example, they can be subjected to higher temperatures without degradation of the gold coating. Composites of gold and silica prepared at pH 2 or 7 tend to disintegrate and separate into the two component parts when heated to 500° C. or 600° C.

It appears that colloidal materials which have a tin oxide or tin silicate coating have a lesser tendency to aggregate or agglomerate when coated with silver. Whether this is due to a retention of a charge on the particles which have tin in their surface layer, or whether there is another explanation is not known. If one wishes to produce a composite powder with minimum aggregation, then it is preferred that the dispersoid be treated with tin oxide or tin silicate prior to silver coating. This can be done by adding a dilute solution of sodium stannate to the dispersoid prior to silver plating. It is possible to apply a coating containing two or more metals to a dispersoid:—colloidal silica can be coated with silver and the silver can be overlaid with copper, as is illustrated in one of the examples.

COMPOSITE POWDER PRODUCTS

The products of the invention comprise a metal and ultrafine particles which particles may or may not be inert. The metal is selected from the group consisting of copper, silver, gold, lead, tin, molybdenum, nickel, cobalt, indium, ruthenium, rhodium, palladium, osmium and platinum. Two or more metals can be applied to the same ultrafine particles sequentially or concurrently. The plated particles when dried become the powders of the invention. The ultrafine particles may be a metal oxide, carbide, nitride, mixed oxide, carbon or any particulate material or an inert material such as silica. The particles or dispersoid must have a particle size below about 20 microns. The preferred range is from 0.005 to 0.5 microns or 5 to 500 nanometers. The amount of dispersoid present in the products will vary with the use to which the products are to be put. Usually the amount is up to about 50 volume percent, however, any volume percent of dispersoid can be prepared. If the dispersoid is present as an extender, the amount of the dispersoid should preferably be in the range of 10 to 40 volume percent. Even lower amounts can be used when the economics are competitive commercially.

The distance between the dispersoid particles has an influence on the ductility of the product. If gold or silver is to be extended, then ordinarily it is preferred that the product be ductile and not hard. In order to achieve this, the particles of the dispersoid should be larger than about 100 nanometers and they should be substantially spherical. If the particles are too large, say larger than about 1 micron, then it is difficult to get a smooth surface finish on the metal product. This effect is undesirable for gold alloys used for jewelry. For jewelry, to accommodate both ductility and surface finish, it is preferred that the particle size of the dispersoid be in the range of 100 to 500 nanometers. One can calculate interparticle spacing if one knows both particle size and volume fraction of the dispersoid. Interparticle spacing greater than 0.2 microns are preferred in composites which must be ductile and which are to be used to extend. For products like silver-tin oxide which are used for electrical contacts and for which surface finish is not critical, particles greater than 1 micron are acceptable.

If the product is to be used as a dispersion hardened metal, then the dispersoid must be refractory, that is, it must have a high melting point and must have a high free energy of formation. Zirconia has a melting point of 2700° C. and a free energy at—100 Kcal per gram atom of oxygen and is a satisfactory dispersoid for dispersion hardening many metals. Other useful dispersoids for dispersion hardening include alumina, yttria, lanthana, thoria, magnesia and other rare earth oxides. The melting point of the dispersoid should be high enough so that the dispersoid will not melt during preparation and use. Moreover, the lower the melting point of the dispersoid, the greater is the tendency that two touching particles of the dispersoid will fuse or agglomerate as temperature is raised.

Composite powders of copper and zirconia can be made which have exceptional hardness and tensile strength without a substantial loss of dictility or electrical conductivity. One of the characteristics of hard copper made from the composite powders described herein, is that the dispersoid is very uniformly dispersed in the metal matrix. This is one of the reasons for the high level of ductility and fatigue strength that can be achieved by the products described herein. The dispersoid particles in composites which are used for dispersion strengthening or dispersion hardening should be much smaller than those used as extenders. It is preferred that the size be less than 100 nanometers and more preferred less than 25 nanometers. The most preferred range is 5 to 15 nanometers.

If the metal is to be subjected to elevated temperature, then there is a chance for the dispersoid to grow by Ostwald Ripening. By way of explanation, when silica aquasols are heated to elevated temperatures, say 200° C. to 300° C., sols which had 25 nanometer particles are not stable. Collioidal silica is soluble in water and since it is and since there is tremendous surface energy, there is a tendency for the small particles to dissolve and plate on the large ones. This growth will in a few hours convert 25 nm silica to 200 nm silica. Such growth is called Ostwald Ripening. It is, in a sense, like recrystallization of sugar in water to form larger crystals. When this occurs, then somewhat more dispersoid should be used so that the interparticle distance will be below 0.2 microns and more preferably below 0.1 microns. For ductility and fracture toughness it is preferred to keep the volume fraction of the dispersoid as low as possible hence is preferred to use low volume loadings of very small particles, for example, particles in the size range of 5 to 15 nanometers and volume loadings at about 1 volume percent. For dispersion hardening it is preferred to use spherical or cubic particles which are dense, discrete and anhydrous. For stiffness or other special effects fibrous or platelike particles can be used.

There are powders which are a product of the processes of this invention which have a core of metal with at least a first layer of another metal plated thereon. For example, in conductive paints, pastes or inks, it is preferable to have a core of one metal e.g., copper or silver, coated with another corrosion resistant metal e.g., gold to achieve good properties.

The most desirable powders are those in which the dispersoid is surrounded by a dense, uniform coating of plated metal and in which aggregation of particles is a minimum. This keeps the plated ultrafine particles separate and discrete. The dispersion of the particles in the products can be shown by electron microscopy. Transmission electron microscopy is particularly useful for this purpose. Thin foils can be prepared by rolling the articles made from the powders to a thickness of about 10 mils followed by jet electropolishing or by ion milling. Solid compacts made from the powders are characterized by being free of fibering of the ultrafine particles. This is a consequence of the fact that each particle is individually coated with a uniform layer of metal which has been electrolessly deposited.

CAST PRODUCTS AND PROCESSES

Many of the powder products made by electroless plating can be melted and cast and during those operations, dispersion of the oxide remains intact. For example, powders containing metal silicate coated silica have been successfully converted to cast products. Coatings on silica which are especially useful in making cast products include copper silicate, nickel silicate, cobalt silicate and tin silicate. Note that these metals all have oxides which can be readily reduced with hydrogen.

Castings can be prepared as follows: colloidal silica is surface coated with a complex oxide or a metal silicate, applying from 1 to 10 monolayers of, say a metal silicate. An overcoat of a metal selected from the group of copper, silver or gold or alloys of these metals is then applied by electroless plating. The precipitate is then dried in hydrogen to remove any last traces of water and reducible oxygen. The powder is then pressed to a pellet, either by cold pressing or by warm pressing. The pellet is then dissolved in a molten metal containing zinc or tin. The metal in the pellet is dissolved and the metal silicate coated particles are dispersed in the melt. The melt is then cast. As an alternative, zinc can be distilled onto a cold pressed pellet and this composite can then be cast.

In the casting processes of the invention, it is essential that oxygen contamination be avoided. Precautions that are taken include: (a) using oxygen and water free gases in the atmosphere over the melts, (b) reducing any surface layer of copper oxide on the powders and (c) eliminating absorbed water on the powders.

USES OF THE PRODUCTS:

To Extend Noble Metals

Noble metals can be extended only if desired characteristics of the noble metal is maintained. For example, one objective of the instant invention is to extend 14K gold. To do this, the product must have the same required qualities that 14K gold now has. The product must be able to accept a surface finish that shows no blemishes. The extended gold must be ductile so that it can be worked and shaped. To be ductile, the spacing between the dispersed particles must be at least 0.2 microns. Small particles will cause spacing between particles to be smaller. Hence in extending 14K gold. there is the necessity to control the size and the shape of the ultrafine particles. This means that any inert particles which are added to 14K gold must be smaller than 1 micron. Aggregates of 1 micron particles are not permitted if the characteristics of the non-extended 14K gold are to be retained.

Fourteen karat gold is an alloy having 58.4% gold, the balance being copper, silver and zinc. If some of the other metals were replaced by a low density, lighter, then for a given volume of 14K alloy, one would require less gold. Gold and its alloys modified in this way are less costly in use. They are somewhat harder than normal and therefore do not scratch and wear as readily. When the particle size and shape of the extender is carefully controlled, these materials are highly ductile and can be converted to bar, sheet, wire, rod and foil. Composites of gold are useful as electrical contacts, in jewelry and for dental use. The other precious metals can also be extended similar to gold.

Silica is an example of a useful extender for gold and its alloys. One reason is because of the large difference in the density of silica and gold. As indicated above, the dispersoid should be present at a volume loading of about 10 to 40 percent. If the particles of the dispersoid are too large, the surface finish of the metal will be impaired. If the particles are too small, the metal will become too hard and will not be ductile. A particle size in the range of from 100 to 500 nanometers is preferred and a size from 100 to 200 nanometers is more preferred. The dispersoid particles should be individual or single particles and should be spherical or nearly spherical in shape.

Fof Dispersion Hardening

Metal-metal oxide composites have been used to harden and strengthen metals and metal alloys. To be most efficient, these materials need to have the smallest and most uniform metal oxide particles dispersed uniformly throughout the composite. In order to achieve this in the most efficient way, to oxide particles which are present in the composite must be discrete, small and separated from each other by layers of metal. This means that in the process of making the composite, there must be no gelatin or aggregation of the metal oxide. This can only be accomplished if there is care taken in the process to avoid gelation and the deposition of porous metal on the oxide. Colloids are tender and readily aggregate or gel. Once the gelatin or aggregation occurs it is not easily reversed. The colloids must be dilute and in an environment of pH in which their particles will not aggregate. The selected pH is such that the colloidal particles will have maximum charge. The pH which is most apt to cause gelation is avoided.

The feed solutions are added to these dilute solutions in separate streams and at rates such that there is never a large excess of the feed in the treating solution at any given time. After the colloids have a thin coating of metal, then the charge due to the colloid is relatively unimportant, but the concentration of the composite in the suspension is still important and is controlled. Further, temperatures are kept as low as possible so that the tendency of the colloid to aggregate will be minimuzed and at the same time allow the plating reaction to occur at reasonable rates. The feed solutions are added so as to allow plating to take place under conditions which are least apt to cause the gelation of the particles. Preferably the feed solutions are added simultaneously but separately.

If the composite powders of the invention are to be used in dispersion hardening, then the particle size should be, for example, preferably less than 100 nanometers in size and more preferably less than 25 nanometers with a resulting much closer interparticle spacing. The volume loading should be much less when the powders are to be used for hardening or strengthening. Volume loadings in the range of 1 to 5 percent are useful and in the range of 1 to 2 percent preferred. If the composite powders are used as master alloys to be added to unmodified metal powders, then the volume loadings can be increased accordingly. If the use objective is to increase the strength of the metal, then the particles should be single and not as aggregates and spherical or near spherical in shape. If the objective is to harden and stiffen the metal, for example copper which is used as the rails in electromagnetic launchers, in which case strength is a lesser consideration, then aggregates may be preferred. Particles which are fibers or platelets will also give the metal stiffness.

As Metallic Inks

Metallic inks involving noble metals are, today, commonly used. These inks require discrete, constant sized and substantially spherical particles in order to achieve good performance. Silver composites containing silica can be prepared in which there is little or no aggregation in the structure. These materials are useful as metallic inks. Silica particles can be obtained in a variety of sizes. "Ludox" from E. I. duPont de Nemours and Company can be purchased in sizes of 7, 12 or 22 nanometers. Colloidal silica can be grown to larger sizes in aqueous solutions by heating under pressure as has already been mentioned (see Iler's book).

A few monolayers of tin oxide or tin silicate deposited on the silica particles will help maintain the particles as separate and discrete during silver plating. There may be some aggregation of the particles during the plating process but in many cases on centrifuging and adding distilled water the silver-silica will peptize into an aquasol. Such aquasols often appear black because of the small particle size.

Creep Resistant Solders

There is a commercial need for a lead-tin base solder which does not creep. Solders must flow when they are liquid. If the solder should be strengthened with oxides, it would be creep resistant. But if the oxide particles in the solder were in the form of aggregates, then the molten solder would be viscous. It has not been possible to make creep resistant solders of the nature or type just described until now. With the processes and the products of this invention it is now possible to economically make solders which are creep resistant.

In Casting Processes

Castings of gold, silver, copper, nickel and their alloys which are dispersion strengthened are not common today because the technology has not prior to this invention been available to make such casting. The properties of composite castings will depend on the size, shape, aggregation and quantity of the dispersing particles in addition to being dependent upon the interparticle spacing. For many uses of the castings, ductility and hardness will be important. Maintaining the dispersed particles in the desired size range and nonaggregated for those uses which demand this is now possible with the processes and the products of this invention.

Copper-zirconia made by processes of the invention are useful as a means for introducing zirconia into cast aluminum alloys. The zirconia gives the aluminum alloy high temperature strength by means of dispersion hardening.

To accomplish this, there must be a wetting agent in the molten metal so that the zirconia is wetted by the molten metal and disperses in it. In a similar way copper-silica can be added to molten zinc, if the proper wetting situation is present. If the silica has a coating of tin silicate it will be wetted by the molten zinc to produce zinc silicate. If the silica has a coating of tin silicate, it will be wetted by a molten metal containing zinc. The basis for this wetting is not really understood, but it is postulated that it is so because the zinc tends to accumulate on the surface of the particle. If there is a limited amount of tin oxide as tin silicate, and if there is an excess of zinc, the zinc layer which builds on the particle is oxygen satisfied at the particle interface, but as the zinc layer builds, there is less and less oxygen, and a graded layer develops which is oxygen rich inside and oxygen poor and metallophilic on the outside.

Listed below are metals useful in the casting processes and products.

FREE ENERGIES OF METALS USEFUL IN CASTING PROCESSES

| METAL | NEGATIVE FREE ENERGY OF FORMATION OF OXIDE AT 27° C. IN Kcal PER GRAM ATOM OF OXYGEN IN OXIDE |
|---|---|
| tin | 60 |
| indium | 65 |
| zinc | 76 |
| manganese | 87 |
| silicon | 98 |
| titanium | 103 |
| vanadium | 99 |
| niobium | 91 |
| chromium | 83 |

EXAMPLES

Listed below is a summary of the examples of the invention which are included as representative of some of the ways in which the invention disclosed herein may be practiced.

SUMMARY

| | |
|---|---|
| Example 1 | Gold-Silica Powder and Sheet |
| Example 2 | Gold-Silica, Effect of pH |
| Example 3 | Gold-Zinc-Silica Casting |
| Example 4 | Gold-Silica at 50 Volume Percent |
| Example 5 | Silver-Silica Colloidal Sol (Tin Coating) |
| Example 6 | Silver-Zinc-Silica Casting |
| Example 7 | Silver-Tin Oxide Composite |
| Example 8 | Copper-Alumina Powder |
| Example 9 | Copper-Zirconia Powder |
| Example 10 | Gold-Tin-Silica Casting |
| Example 11 | Copper-Silver-Zinc-Silica Casting |
| Example 12 | Copper-Silica |

EXAMPLE 1

This is an example of a process of the invention. It is also an example of a product of the invention. The product is gold containing 10 volume percent silica. The process involves preparation of a gold-silica powder prepared by plating gold on silica. The powder was dehydrated and then hot pressed to a slug. The slug was rolled to form a sheet of gold-silica. The gold-silica sheet is useful in making electrical contacts and contains 10% less gold per contact than pure gold.

The silica used to prepare the gold-silica powder was prepared by autoclaving "Ludox" from E. I. duPont de Nemours and Company. Originally the "Ludox" was an aquasol containing 22 nanometers silica particles. The aquasol was diluted 10:1 with distilled water. Cation exchange resin, C-100, in the hydrogen form was used to remove the cations from the diluted "Ludox". It should be noted that any cation exchange resin which contains a strong acid group can be used, In general any sulfonic acid resin is satisfactory. Four hundred (400) milliliters of deionized sol was mixed with 400 milliliters of diluted but not deionized sol. The pH of the mix was 7. This sol was then heated in a pressure autoclave to 250° C. for 24 hours. The resulting aquasol contained 120 nanometer silica particles.

Chlorauric acid was prepared by dissolving gold in acid as follows: 20.4 grams of gold was treated with aqua regia. After the gold had dissolved, the solution was concentrated by boiling and additional hydrochloric acid was added and boiling repeated until all the nitric acid was removed. The final volume of the solution was 220 milliliters. It contained 0.093 grams of gold per milliliter.

The plating occurred in a 1 liter creased flask equipped with a stirrer. The creases in the flask acted as baffles to increase the turbulence in the flask with the result that the feeds were instantly mixed with the silica sol in the flask.

The heel (starting solution) placed in the flask consisted of 150 milliliters of aquasol containing 66 milligrams of silica. This silica has a surface area of 25 square meters per gram, hence there were 1.65 square meters of silica surface in the heel.

Feed solutions were prepared as follows: (a) the gold solution: 54 milliliters of the above chlorauric acid solution was diluted to 100 milliliters. This solution contained 5 grams of gold or 25.4 millimoles of gold. (b) 13.5 grams of hydroxylamine dissolved in water and diluted to 100 milliliters for the reducing agent.

As indicated, the plating reaction occurred in a creased flask to provide efficient mixing. Feeds were added through proportionating pumps so that feed rate would be constant and controlled. The reaction temperature was 21° C. Feeds were added simultaneously but separately over a period of 0.5 hours. The feed rate of gold was thus 0.85 millimoles per minute of 0.5 millimoles of gold per minute per square meter of silica surface. The pH was held at 4 during the reaction and was kept at 4+ or −0.5 by addition of ammonia. The product was a reddish precipitate which was filtered and dried at 100° C. for 1 hour and then 400° C. for an additional hour.

A scanning electron micrograph of the powder showed that it consisted of spherical particles which were about 0.2 microns in diameter. The particles were aggregated into clusters each of which consisted of several spherical particles. No silica was exposed, as verified by energy dispersive X-ray analysis on a scanning electron microscope, showing that the coating of gold was complete. From the electron micrographs it was evident that each silicate particle was in the center of the gold-silica composite and that the coating was uniformly applied and substantially uniform in thickness. This powder is a product of the invention.

The powder was hot pressed to a slug at 700° C. The slug was rolled to a sheet. There was excellent ductility as shown by the fact that, on rolling from 0.063 inch to 0.004 inch, the slug showed no tendency to crack. The gold silica sheet is a product of the invention. The sheet contains silica particles which are 120 nanometers in diameter on the average. The particles are uniformly dispersed throughout the sheet at 10 volume percent.

EXAMPLE 2

This example is similar to example 1, except that there was 30 volume percent silica in the powder. The powder was heated to 600° C. and then examined by electron microscopy. After this thermal treatment, there was no visible change in the powder.

Another powder was prepared at pH 2.5 and 15 volume percent. The pH was controlled by using less ammonia. The pH 2.5 powder was nonuniform in appearance, there being shapes which looked like worms. These were cross linked into larger aggregates. There was also present large spherical aggregates which were about 2–4 microns in diameter and which looked solid.

A third powder was prepared at 30 volume percent and pH 7 by using more ammonia. Scanning electron microscope pictures showed that this powder was similar to but more aggregated than the pH 4 powder. When the pH 7 powder was heated at 300° C. there was a gross rearrangement of the structure, the shapes originally present were no longer discernable and silica surfaces were exposed. When this powder was hot pressed and rolled, ductility was only fair.

This example shows that it is preferred to operate the gold plating process at or near pH 4. This is particularly true if one wishes to dehydrate the powder or convert it to powder metallurgy products which have good ductility.

EXAMPLE 3

This is an example of a product of the invention which is useful in making castings. In this example, the silica is first coated with tin silicate and this is overlaid with a coating of gold. The tin silicate coating was thin, being about 3 monolayers thick. The silica, itself, was 200 nanometers in diameter. This size was obtained by autoclaving "Ludox" at about 300° C. for 15 hours. The silica was coated by tin silicate by feeding sodium silicate and sodium stannate simultaneously into the silica sol at a temperature of 90° C. The heel (silica sol in the flask) contained 3 grams of 200 nanometers silica in 400 milliliters of solution. The sodium silicate feed was prepared by dissolving 1.42 grams of sodium metasilicate nine hydrate in 300 milliliters of water. The stannate solution was prepared by dissolving 1.33 grams of sodium stannate trihydrate in 300 milliliters of water. The pH during the coating was held at 9.5 by the addition of 0.5N HCl. Feeds were added over a period of 1 hours. The concentration of coated silica in the final sol was 0.3 percent.

Electron micrographs of the starting and coated sol showed that there had not been aggregation of the silica during coating nor had there been a measurable change in particle size. The gold coating was performed in a 3 liter creased flask. The heel in the flask contained 0.30 grams of silica in 1200 milliliter. The feed solutions contained (a) 15 grams of gold as chlorauric acid in 900 milliliters of solution and (b) 40.5 grams of hydroxylamine hydrochloride also in 900 milliliters. The pH during plating was 4 and the temperature was 21° C. The feed rate was 15 milliliters per minute. The rate of adding gold was 0.3 millimoles per minute per square meter of colloid surface.

After the gold was deposited, the precipitate was filtered, washed with water and dried at 200° C. The powder was 15 volume percent dispersoid, the dispersoid being tin silicate coated silica.

One part of the gold-silica composite was cold pressed to a slug. A hole was drilled through the slug and the slug was suspended on a copper wire. Three parts of oxygen free zinc were place in a quartz tube and the slug was suspended above the zinc by a iron washer attached to the wire and the washer was held in place by a magnet on the outside of the tube. The quartz reactor was air tight. It was evacuated and back filled twice with high purity argon. The zinc was melted and heated to 700° C. The slug was then dropped into the molten zinc and then left for one half an hour at 700° C. The gold dissolved in the zinc and the silica which was thereby released was wetted by and dispersed in the molten gold-zinc alloy. Much of the zinc was distilled out by evacuating and heating the reactor to 800° C. leaving a gold-silica casting which could be recast without slagging of the silica.

The experiment was repeated with silica which had not been tin silicate coated. The unmodified silica slagged out of the melt apparently because in the unmodified form it was not wetted by the molten metal.

These experiments have been repeated several times (often with the use of a graphite crucible in place of the quartz) and the unmodified silica slags each time. Each time tin silicate modified silica is used it is wetted and remains dispersed in the molten metal. Coating of nickel silicate, or cobalt silicate or copper silicate have been substituted for tin silicate coated silica. These coated silicas were each plated with gold as above. Each of the coatings were effective in preparing stable dispersions of silica in molten zinc-gold alloys and castings in which silica is dispersed.

By adding copper and silver in the proper amounts, it is possible to make 14K gold alloys with the gold-zinc-silica casting which have been described above.

EXAMPLE 4

This is an example of a gold-silica composite which was prepared by the electroless deposition of gold on colloidal silica and which was 50 volume percent silica. The colloidal silica solution used as the heel contained 0.57 grams silica in 150 milliliters. The feed solutions were 100 milliliters each, the gold solution contained 5 grams gold and the reducing solution contained 13.5 grams of hydroxylamine hydrochloride. The temperature of plating was 21° C. The feed solutions were added over a one half hour period through proportionating pumps and the pH was maintained at 4 by the addition of dilute ammonium hydroxide.

The product of silica covered with a uniform layer of gold was recovered by filtering, washing, drying and heating to 400° C.

EXAMPLE 5

This is an example of silver plating on colloidal silica. The example shows that with a tin silicate coating on silica it is possible to prepare silver coated silica in the form of an aquasol. Two processes are described in this example, in the first the silica has a tin silicate coating and in the second the silica is used as is. With the tin silicate coating, the product is an aquasol and without a coating, the product is a precipitated silver-silica. In the first case, the silica is coated with tin silicate as in example three, except that the coating was about 10 monolayers thick, i.e., 3.3 times as much stannate and silicate was used. The aquasol contained 0.41 grams of tin silicate coated silica per 100 milliliters of aquasol. For the silver coating, 58 milliliters of this sol was diluted to 200 milliliters. (making the concentration 0.12 grams silica per 100 milliliters). This 200 milliliters was the heel for the coating. Feed solution (a) was prepared by dissolving 0.79 grams of silver nitrate in water added 1.1 milliliters of concentrated ammonia (30% ammonia) and diluting to 50 milliliters. Feed solution (a) contained 0.5 grams of silver in the 50 milliliters of solution. Feed solution (b) was formaldehyde in water and contained 1.2 milliliters of 37% formaldehyde diluted to 50 milliliters with water. The two solutions were fed into a creased flask containing the tin silicate coated silica particles. The feed rates were 5 milliliters per minute for each feed. Temperature was maintained at 50° C. and the pH was maintained at 9 by the addition of dilute ammonia solution. The silver was fed at a rate of 0.9 millimoles per minute. The surface area of the tin silicate coated silica was 15 square meters per gram, giving a total tin silicate surface in the heel of 3.6 square meters. The feed rate was thus 0.25 millimoles of silver per minutes per square meter of silicate surface.

There was no precipitate in the solution after the run was completed. The product was a colloidal aquasol, which had a black appearance because of the fine size of the silver coated particles. The tin silicate coated silica was 70 percent by volume of the composite particles. The sol was stable in that the particles remained dispersed for more than 3 days at room temperature. When the particles finally did settle, the sol could be "regenerated" by stirring and the particles would remain dispersed after this for two hours.

This product is useful in silk screen inks. The silver coated silica could be transferred to an organic solvent by mixing the aquasol with butanol, for example, and distilling out the water.

When the same process was repeated using a silica sol that had not been treated with tin silicate, the particles of silica coagulated soon after the silver coating was started and the product was a precipitated silver coated silica.

EXAMPLE 6

This is an example of a casting of silver containing dispersed silica particles.

A silver-silica powder was prepared using silica particles which had been coated with copper silicate. The copper silicate coating on 200 nanometer silica was done by substituting copper nitrate for sodium stannate and keeping the pH at 9 with dilute ammonia. The ratio of copper to silica in the coating was 0.9:1. Silver was applied to this silica by electroless plating as was done in example 5. The powder product was 30 volume percent silica and the balance silver.

The precipitate was recovered by decanting and washing with distilled water. The excess water was removed by filtration. The resulting powder was dried at 120° C. and finally at 250° C. under hydrogen. The powder so obtained was sieved through 100 mesh. This powder was then hot pressed [note that the powder could also have been cold pressed into a slug] to full density in a graphite die at 700° C.

A master alloy was prepared using 70.1% silver and 29.9% zinc, by melting a mixture of silver and zinc powders together in a graphite container at a temperature of 800° C. for 30 minutes. The zinc melted and dissolved the silver. The melt was covered with graphite powder during melting to protect it. The melt was cooled, polished to remove the surface contamination and then rolled.

To make the silver-zinc-silica casting, 0.96 parts of hot pressed silver-silica and 3.53 parts of the master alloy (zinc-silver) were placed in a graphite container and covered with carbon black. This was then heated to 800° C. under hydrogen and held at temperature for one hour. The master alloy melted and dissolved the silver in the silver-silica composite. The silica in the composite dispersed in the molten metal and remained as a uniform dispersion on casting. The casting was rolled. The rolled sheet was uniform in appearance. The product was a zinc-silver alloy in which there were dispersed particles of finely divided silica.

EXAMPLE 7

A tin oxide aquasol was prepared by dispersing tin oxide in a dilute ammoniacal solution. Ten (10) grams of tin oxide was added to 1 liter of water containing one drop of 30% ammonia. The pH was 9. The suspension was milled using stainless steel balls for four hours. The product was a stable tin oxide sol containing 1 weight percent tin oxide.

This tin oxide aquasol was used as a heel into which the feed solutions were introduced through capillary tubes. Solution (a) contained 15.75 grams of silver nitrate and 22.5 milliliters of ammonia (30%) in 400 milliliters. Solution (b) contained 15 milliliters of formaldehyde (37%) in 400 milliliters. The two solutions were fed at a rate of 10 milliliters per minute, while keeping the temperature at 50° C. and the pH at 9. The feed rate of the silver was 0.2 millimoles per minutes per square meter of surface of colloid in the heel.

The precipitated silver-tin oxide composite was filtered and dried at 100° C. in air. It was then hot pressed into slugs. The composite is useful as an electrical contact.

EXAMPLE 8

Two copper-alumina powders were prepared both of which had 10 volume percent alumina.

The first was using 0.3 micron alumina. Two (2) grams of this alumina was dispersed in 1 liter of water at pH 8.5 (using ammonia). This alumina "sol" was diluted so that there were 0.59 grams of alumina in 300 milliliters of solution. This was used as the heel into which two feed solutions were introduced. Solution (a) was prepared by mixing three solutions: 32.2 grams of copper chloride in 200 milliliters and 90 grams of sodium potassium tartrate in 200 milliliters and 60 grams of sodium hydroxide with 30 grams of sodium carbonate in 200 milliliters. Solution (b) consisted of 60 milliliters of 37% formaldehyde solution diluted to a total volume of 600 milliliters. These feeds were added at a rate of 10 milliliters per minute to the heel which was maintained at 80° C. and pH 12. The copper-alumina was filtered, washed and dried in a flow of hydrogen at 250° C. The experiment was repeated using 50 nanometer alumina.

EXAMPLE 9

A zirconia aquasol having 5 nanometer particles was prepared as follows. A one molar zirconia oxychloride solution was autoclaved at 125° C. The product was a zirconia sol containing 12% solids. The sol had a relative viscosity of 1.41 which corresponds to about 63% solids in the dispersed phase. When the sol was dried to a powder, the powder had a surface area of 200 square meters per gram. The sol was diluted to 1 percent solids and an equal volume of this diluted sol and 0.03 percent sodium metasilicate was fed into a heel of water at ph 9. The final silicate coated zirconia sol was diluted to 0.3 grams per liter and then the zirconia was copper coated as in example 8.

EXAMPLE 10

This example illustrates a gold-silica powder in which the silica had been surface coated with copper silicate and also a casting was made using the powder. The results show that the copper silicate coating or a metal silicate coating is essential to making a satisfactory casting.

A gold-silica powder was prepared using 200 nanometer silica which had been coated with 10 monolayers of copper silicate. The copper silicate coating had a mol ratio of copper to silica of 0.8:1. It was prepared by feeding copper chloride and sodium silicate into the silica sol at 80° C. and a pH of 9. This copper silicate coated silica was used in a process in which gold was electrolessly deposted on the modified silica. The process for depositing the gold was like in example 3 and the pH was 4, and the temperature was 21° C. The gold addition rate was 0.3 millimoles per minutes per square meter of colloid surface. The concentration of copper silicate coated silica in the gold was 15 volume percent.

Melted in a graphite container was 6.4 grams of pure (oxygen free) tin. To the molten tin, 1.1 grams of gold-silica was added. The gold dissolved and the silica was dispersed in the melt. The process was repeated, but the copper silicate coat on the silica was omitted. In this case the silica slagged out, showing that the copper silicate reacted with the tin and caused the silica to become metallophilic.

EXAMPLE 11

This example describes a copper-silver-zinc-silica casting Copper-silver-silica powder was prepared by electroless plating. The powder was cold pressed and zinc was added as a vapor which was condensed on the copper-silver-silica and the composite was melted and cast. Copper and silver were electrolessly deposited on 200 nanometer colloidal aluminum silicate.

The aluminum silicate used in this example was coated with tin silicate as in example 3. The tin silicate coated aluminum silicate aquasol was placed in a creased flask reactor and used as a heel to start the reaction. The heel of 1 liter of colloidal solution contained 1 gram of treated aluminum silicate. Silver was deposited on this aluminum silicate by feeding two solutions into the reactor at 50° C. and a pH of 9 as follows: a solution (a) consisted of 1.58 grams of silver nitrate dissolved in 75 milliliters of distilled water containing 3 milliliters of 30% ammonia and a solution (b) was 1.5 milliliters of 37% formaldehyde diluted to 75 milliliters. The feed rate was 10 milliliters per minute. The feed rate of the silver was 1.2 millimoles per minute and since there was 1 gram of coated aluminum silicate having a surface area of 8 square meters per gram, the silver feed rate was 0.15 millimoles per minute per square meter of surface in the plating bath.

Following silver deposition, copper was deposted using two feed solutions as follows: a solution (c) os 19.4 grams of copper chloride dihydrate was dissolved in 120 milliliters of water. Separately, 54 grams of sodium potassium tartrate was dissolved in 120 milliliters of water and in a third container 36 grams os sodium hydroxide and 18 grams of sodium carbonate were dissolved in 120 milliliters of water. These three solutions were combined to make 360 milliliters of solution (a). Another solution (d) of 36.1 milliliters of 37% formaldehyde was diluted to 350 milliliters. The two feed solutions were added at 10 milliliters per minute at a temperature of 80° C. and pH of 12. The copper feed rate was 3.2 millimoles per minute, the surface exposed was 8 square meters, hence the feed rate was 0.4 millimoles of copper per minute per square meter of surface of the particles being plated. The silver was fed as the diamine complex and the copper as the tartrate complex. The volume loading of the aluminum silicate in the copper-silver-aluminum silicate composite was 15 percent. The copper-silver-aluminum silicate was dried at 100° C. under hydrogen and then heated to 400° C. to reduce any copper oxide. The powder was screened to minus 140 mesh.

One hundred and one (101) parts of this powder were treated with 10.2 parts of zinc by vapor distilling the zinc onto the powder. This zinc-copper-silver-silicate composite was then melted at 980° C. and held at that temperature for 20 minutes. Thereafter it was cooled. The resulting casting was a copper-silver-zinc alloy having submicron aluminum silicate uniformly dispersed throughout it.

EXAMPLE 12

An magnesium silicate sol having particle similar in size and shape to the silica particles as in Example 3 was coated with 10 monolayers of nickel silicate, according to the process of Example 3. A deposit of copper was then applied to the modified magnesium silicate as in example 8. The oxide concentration in the composite was 15 volume percent.

The precipitate was filtered, dried in hydrogen at 200° C. and hot pressed to a fully dense slug. The pressed slug was placed in a graphite crucible along with a copper zinc alloy and covered with carbon black. The crucible was then placed in a reactor which was evacuated and back filled with high purity argon. It was then heated in a resistance furnace to 1100° C. and held at that temperature for about 20 minutes.

The product was a copper-magnesium silicate casting which could be readily rolled to a sheet 10 mils thick.

What we claim is:

1. An ultrafine composite powder consisting of a plurality of ultrafine particles, said particles comprising:
   a core portion of material having an average size less than about 20 microns; and
   a coating portion comprising a plurality of layers, a first layer adjacent to and contiguous with the surface of said core portion being a complex oxide and each of the other layers being a substantially uniform, stable and dense deposition of at least one metal selected from the group consisting of copper, silver, gold, lead, tin, nickel, zinc, cobalt, antimony, bismuth, iron, cadmium, chromium, germanium, gallium, selenium, tellurium, mercury, tungsten, arsenic, manganese, iridium, indium, ruthenium, rhenium, rhodium, molybdenum, palladium, osmium and platinum.

2. The ultrafine particles according to claim 1 wherein said core portion material is silica and being substantially spherical and having an average size of between about 100 and 500 nanometers, a density of less than about 4 grams per milliliter and comprising between about 10 and 50 percent by volume of the particle.

3. The ultrafine particles according to claim 1 wherein said core portion material is a water insoluble metal silicate and being substantially spherical and having an average size of between about 100 and 500 nanometers, a density of less than about 4 grams per milliliter and comprising between about 10 and 50 percent by volume of the composite particle.

4. The ultrafine particles according to claim 2 wherein said other layers of said coating portion is copper.

5. The ultrafine particles according to claim 2 wherein said other layers of said coating portion is gold.

6. The ultrafine particles according to claim 2 wherein said other layers of said coating portion is silver.

7. A plated ultrafine powder consisting substantially of a plurality of ultrafine particles, said particles comprising:

a core portion of material selected from the group consisting of insoluble metal silicates, complex oxides, and tin oxide and having an average particle size of less than about 1 micron; and a coating portion comprising at least one layer adjacent to and contiguous with the surface of said core portion and being a substantially uniform, stable and dense deposition of at least one metal selected from the group consisting of copper, silver, gold, lead, tin, nickel, zinc, cobalt, antimony, bismuth, iron, cadmium, chromium, germanium, gallium, selenium, tellurium, mercury, tungsten, arsenic, manganese, iridium, indium, ruthenium, rhenium, rhodium, molybdenum, palladium, osmium and platinum, and alloys containing a total of at least 25% of at least one of said metal.

8. A plated ultrafine powder consisting substantially of a plurality of ultrafine particles, said particles comprising:

a core portion of an oxide material selected from the group of water insoluble metal silicates and having an average particle size of less than about 1 micron; and a coating portion comprising at least one layer adjacent to and contiguous with the surface of said core portion and being a substantially uniform, stable and dense deposition of at least one metal selected from the group consisting of copper, silver, gold, lead, tin, nickel, zinc, cobalt, antimony, bismuth, iron, cadmium, chromium, germanium, gallium, selenium, tellurium, mercury, tungsten, arsenic, manganese, iridium, indium, ruthenium, rhenium, rhodium, molybdenum, palladium, osmium and platinum, and alloys containing a total of at least 25% of at least one of said metal.

9. A plated ultrafine powder consisting substantially of a plurality of ultrafine particles, said particles comprising:

a core portion of tin oxide and having an average particle size of less than about 1 micron; and a coating portion comprising at least one layer adjacent to and contiguous with the surface of said core portion and being a substantially uniform, stable and dense deposition of at least one metal selected from the group consisting of copper, silver, gold, lead, tin, nickel, zinc, cobalt, antimony, bismuth, iron, cadmium, chromium, germanium, gallium, selenium, tellurium, mercury, tungsten, arsenic manganese, iridium, indium, ruthenium, rhenium, rhodium, molybdenum, palladium, osmium and platinum, and alloys containing a total of at least 25% of at least one of said metal.

10. A plated ultrafine powder consisting substantially of a plurality of ultrafine particles, said particles comprising:

a core portion of zirconia powder particles and are of a size between about 5 and 25 nanometers and a coating portion comprising at least one layer adjacent to and contiguous with the surface of said core portion and being a substantially uniform, stable and dense deposition of copper.

11. A plated ultrafine powder consisting substantially of a plurality of ultrafine particles, said particles comprising:

a core portion of molybdenum and a coating portion comprising at least one layer adjacent to and contiguous with the surface of said core portion and being a substantially uniform, stable and dense deposition of copper.

12. A plated ultrafine powder consisting substantially of a plurality of ultrafine particles, said particles comprising:

a core portion substantially spherical in shape and having an average particle size of between about 0.01 and 1.0 microns said core portion of material selected from the group, consisting of silica, insoluble metal silicates, complex oxides, and tin oxide; and a coating portion comprising at least one layer adjacent to and contiguous with the surface of said core portion and being a substantially uniform, stable and dense deposition of at least one metal selected from the group consisting of silver and gold, and alloys containing a total of between 50% and 90% by volume of at least one of said metal.

13. the ultrafine particles according to claim 12 wherein said core portion is silica substantially spherical in shape and having an average size of between about 0.02 and 1.0 microns.

14. A plated ultrafine powder consisting substantially of a plurality of ultrafine particle, said particles comprising:

a core portion selected from the group of oxides consisting of tin oxide and zinc oxide and having an average particle size of between about 0.5 and 5.0 microns; and a coating portion comprising at least one layer adjacent to and contiguous with the surface of said core portion and being a substantially uniform, stable and dense deposition of silver.

* * * * *